US005894774A

United States Patent [19]

Trimble

[11] Patent Number: 5,894,774

[45] Date of Patent: Apr. 20, 1999

[54] METHOD OF CUTTING CLOTH MATERIALS

[76] Inventor: Perry C. Trimble, 7526 Forest Park Dr., Indianapolis, Ind. 46217

[21] Appl. No.: 08/980,216

[22] Filed: Nov. 28, 1997

[51] Int. Cl.[6] ..... B26B 29/02; B43L 7/00

[52] U.S. Cl. ..... 83/13; 30/289; 30/292; 30/295

[58] Field of Search ..... 30/286, 289, 290, 30/292, 294, 295; 83/13

[56] References Cited

U.S. PATENT DOCUMENTS 745,515 12/1903 Perks ..... 30/292

FOREIGN PATENT DOCUMENTS

| | | | |
|---|---|---|---|
| 76534 | 4/1948 | Czechoslovakia | 30/286 |
| 15574 | 7/1905 | United Kingdom | 30/289 |
| 90/02636 | 3/1990 | WIPO | 30/295 |

*Primary Examiner*—Hwei-Siu Payer
*Attorney, Agent, or Firm*—Daniel O'Connor

[57] ABSTRACT

A guard for use with rotary cutters in the cloth cutting and related arts. The design includes a wide, clear plate for placement over cloth to be cut and an upturned edge portion to allow application of a rotary cutter device. The method steps of the invention use the apparatus in combination with a guide ruler to enable the easy and safe use of conventional rulers in combination with rotary cutting devices.

1 Claim, 2 Drawing Sheets

METHOD OF CUTTING CLOTH MATERIALS

BACKGROUND AND OBJECTS OF THE INVENTION

The present invention is generally related to the rotary cutter and guard arts and to a novel method and apparatus for protecting the user of items such as rotary cutters.

Prior art rotary cutter guarding means have generally been attached to the lateral portions of a rotary cutter as illustrated by the cited patents.

Such designs, while somewhat effective, are costly to add to a rotary cutter and still do not fully perform the needed safety requirements for the user.

A simpler and easier to use design for rotary cutter systems would therefore be of advantage in the art.

Accordingly, it is an object of the invention to show a novel rotary cutter guard which is economical to make and sell for widespread commercial appeal.

It is further object of the invention to demonstrate a novel rotary cutter guard which is easy to use by the consumer to enhance the desired safety and work results.

These and other objects and advantages of the present invention will be apparent to those of skill in the art from the description which follows.

PRIOR ART PATENTS AND DESIGNS

U.S. Pat. No. 4,024,633 teaches the use of a safety guard for a cloth cutting machine. The guard must be added to the machine and thus requires rather extensive manufacturing changes.

U.S. Pat. No. 4,062,111 shows the use of a knife guard for a cloth cutting machine. Such design also requires the addition of costly equipment to the cutting machine.

The above prior art designs are generally related to the present invention.

The present invention, however, does not require the costly machine changes of the prior art and effectively provides ease of use and flexibility for users of rotary cutter machines.

The present invention also increases safety factors for those artisans in the cutting arts.

SUMMARY OF THE INVENTION

The invention apparatus comprises a clear, flat plate having an upturned edge portion to allow a cutter blade to perform its intended function while reducing risk of injury to the user.

In the method usage of the invention, the guard structure allows a guide ruler to be used in combination with the guard by placing such ruler beneath the flat surface.

BRIEF DESCRIPTION OF THE DRAWING FIGURES

DESCRIPTION OF A PREFERRED EMBODIMENT

Figure 1:
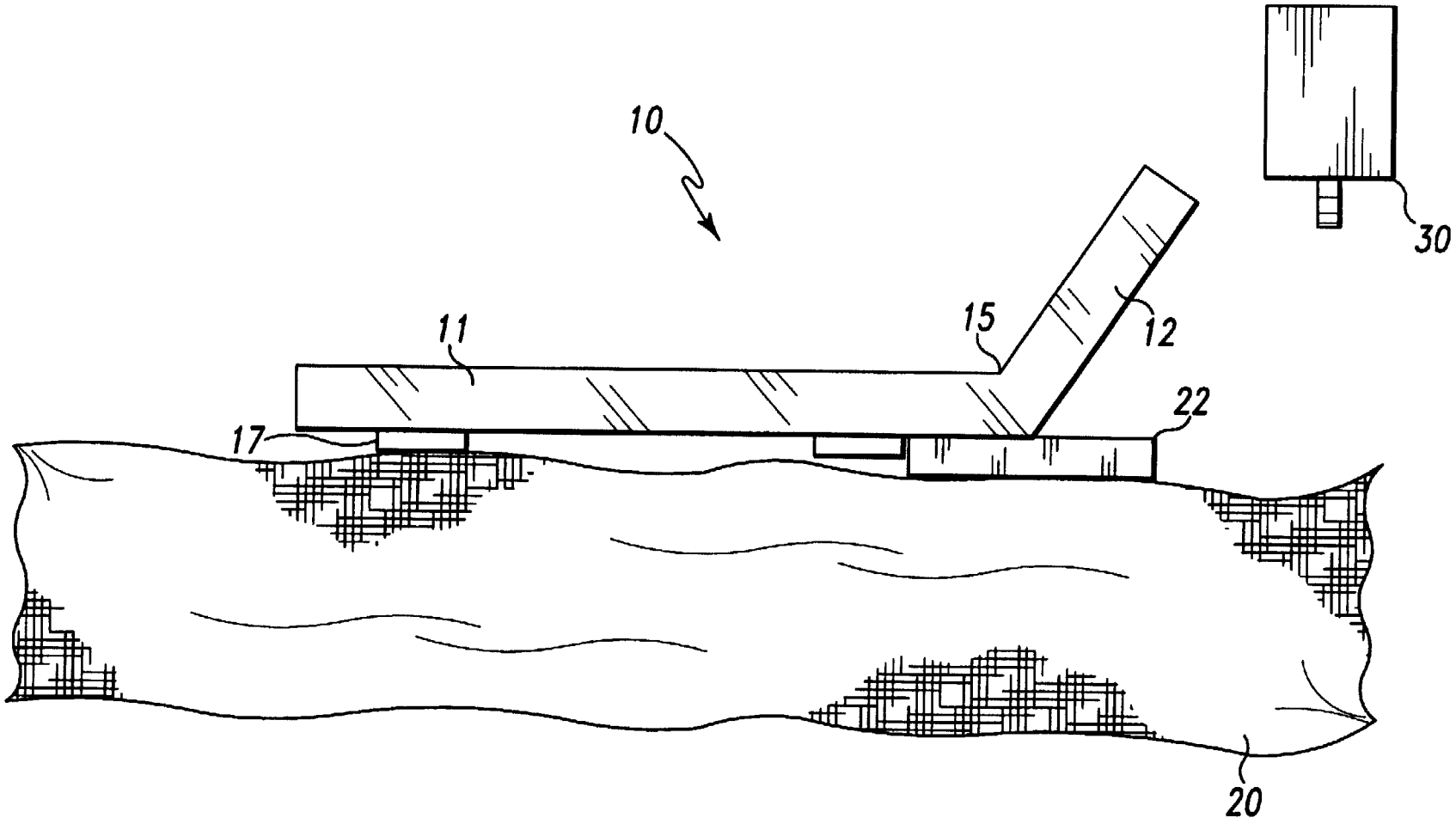
FIG. 1 shows a side end view of the guard and illustrates its usage in combination with cloth to be cut, a guide ruler and a rotary cutter.

Referring to the drawing FIG. 1, a section of cloth 20 to be cut is shown. A conventional rotary cutter to be used on the cloth is indicated at numeral 30.

In conventional operations, the rotary cutter 30 would be applied along a guide ruler 22 to make the desired cut along the cloth section.

In accord with the present invention, a safety guard element 10 is used in combination with the conventional elements 22 and 30.

The guard member 10 consists of a flat portion 11 of of sufficient width and length that a user of the device has room to place a hand upon it. The guard 10 and ruler 22 are thus able to be held securely in the desired position for the cutting operation.

The guard 10 also includes an upwardly angled portion 12 to enable the rotary cutter 30 to be utilized while protecting the hand and fingers of the user.

The particular angle 15 used in the device may vary depending upon needs in the art. Angles of 105 and 120 degrees, for example, have been successfully used and tested with the device.

In the method of operation of the design, the ruler 22 and guard 10 are placed in a desired position upon the cloth 20 and the rotary cutter 30 is applied along the edge of the ruler to make the desired cut.

Figure 2:
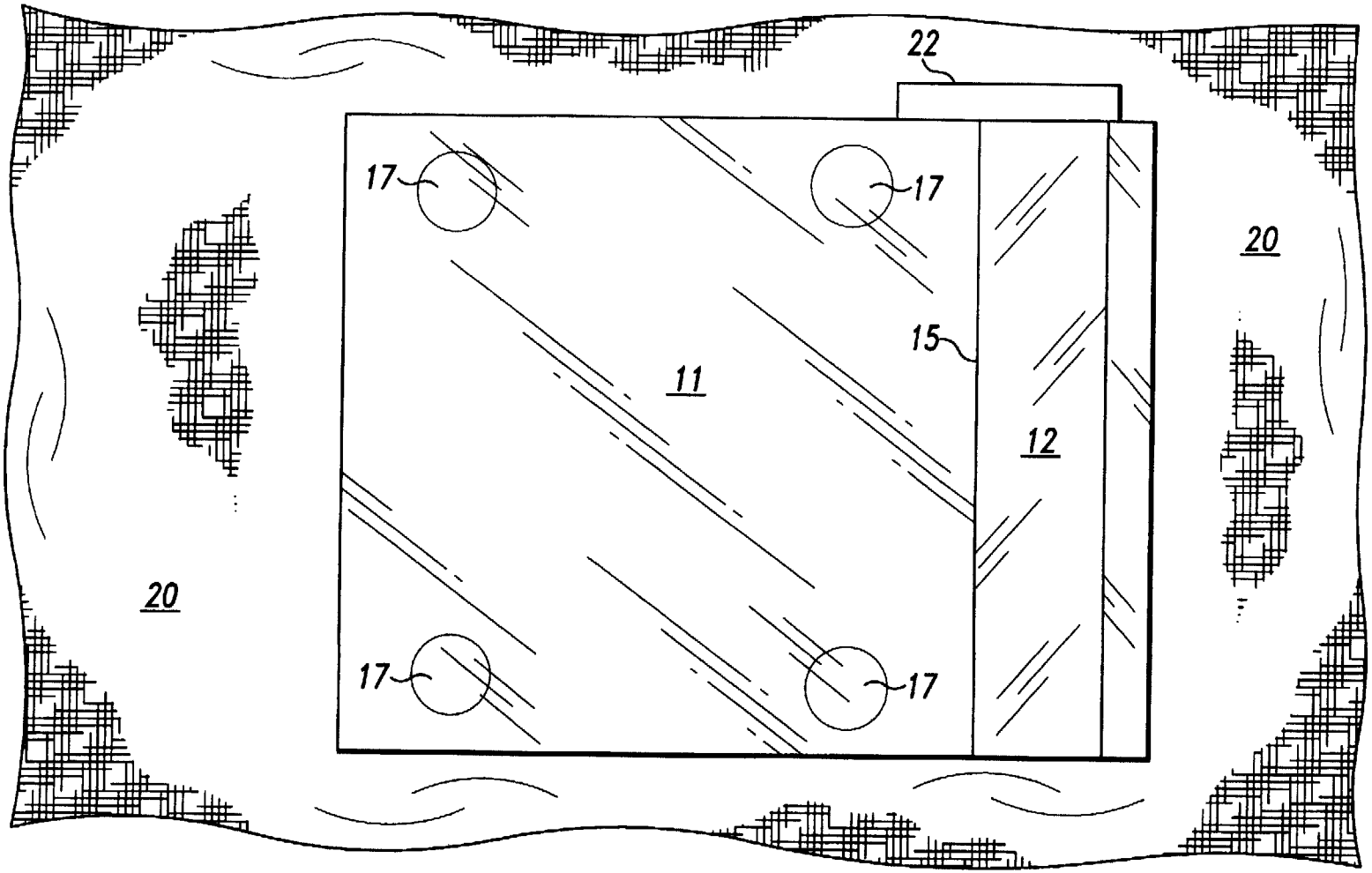
FIG. 2 shows a top view of the guard and shows the overall size and advantageous shape of the design.

The top view of FIG. 2 shows the relative sizing and dimensions of the flat portion 11 as compared to the angled portion 12. As indicated, the area of the angled portion would be relatively smaller than the area of the flat portion 11. The flat portion is sized such that a user's hand may be placed upon it to provide a safe and secure cutting operation.

The materials of the device comprise a clear plastic or equivalent material such as Lucite. The clear material design allows the underlying cloth and ruler to be viewed in the set-up and cutting operation for increased efficiency and convenience of the user.

The safety guard of the present invention may be economically mass-produced for widespread commercial appeal. The rotary cutter 30 need not be modified to achieve the desired safety results thus reducing manufacturing costs while simultaneously improving use and safety for the consumer.

As a further safety feature, the design includes plural plastic gel-type grip elements 17 located at or near the corners of the flat plate 11. Such grip elements 17 perform an anti-slip function to facilitate the cutting operation.

While a particular embodiment and method have been shown and described, it is intended to cover all equivalent structures and methods which would reasonably occur to those of skill in the art.

The invention is further defined by the claims appended hereto.

I claim:

1. A method of safety cutting cloth materials comprising the steps of:

providing a rotary cutter;

providing a section of cloth to be cut;

providing a flat clear plate having an upwardly angled edge means and having downwardly extending grip elements at four corners of said flat plate;

placing said flat plate on said cloth section;

placing a guide ruler between said flat plate and said cloth section so that an edge of said guide ruler distal of said grip elements is positioned beneath said angled edge means;

pressing said flat plate downwardly so that said grip elements rest on said cloth section and prevent slippage of said flat plate; and sliding said rotary cutter along said edge of said guide ruler to cut said cloth section while said angled edge means protects a user during cutting.

* * * * *